United States Patent [19]

Riba nee Hildebrand

[11] 4,372,065

[45] Feb. 8, 1983

[54] BLOWER FOR A PRESSING TABLE

[76] Inventor: Jutta Riba nee Hildebrand, Rosenbergstr. 26, D-5455 Hardert, Fed. Rep. of Germany

[21] Appl. No.: 189,232

[22] Filed: Sep. 22, 1980

[30] Foreign Application Priority Data

Sep. 25, 1979 [DE] Fed. Rep. of Germany ..... 2938789

[51] Int. Cl.[3] ..... D06F 71/34

[52] U.S. Cl. ..... 38/15; 38/103

[58] Field of Search ..... 38/14, 15, 104, 16, 38/3, 103, 104

[56] References Cited

U.S. PATENT DOCUMENTS

| | | | |
|---|---|---|---|
| 1,729,353 | 9/1929 | Mitkoff | 38/103 |
| 4,166,331 | 9/1979 | Wallace | 38/15 |
| 4,259,796 | 4/1981 | Riba et al. | 38/15 |

FOREIGN PATENT DOCUMENTS

| | | | |
|---|---|---|---|
| 2705511 | 8/1978 | Fed. Rep. of Germany | 38/15 |
| 2744507 | 4/1979 | Fed. Rep. of Germany | 38/15 |

*Primary Examiner*—Louis Rimrodt

*Attorney, Agent, or Firm*—Donald Brown

[57] ABSTRACT

A pressing table has a main pressing surface element and a pivotable additional pressing table surface element, and a blower capable of applying suction or blowing action selectively to one or other of the pressing table surface portions. Change over from suction to blowing is achieved by the action of the blower fan discharge air in response to triggering by a solenoid thruster, and the blowing action is held on by the airstream until the blower fan stops. Selection of the additional pressing table surface element for the blowing or suction action is automatic in response to pivoting of the additional element from a rest position to an operative position.

6 Claims, 3 Drawing Figures

BLOWER FOR A PRESSING TABLE

DESCRIPTION

The invention relates to a blower for a pressing table having feed ducts, connected to the suction side and/or blow side of the blower fan and leading to the pressing surface, and a change-over device which has an off position, a "suction" position and a "blow" position.

Blowers of this type are mounted in a known manner on the base frame of a pressing table. The blower fan is connected via a change-over box and a telescopic tube to the upper part of the pressing table, which is adjustable in height. The adjustment in height is effected by correspondingly extending the telescopic connection to a greater or lesser degree. Pressing, on the pressing table, is carried out using a steam iron. The steam is extracted as quickly as possible by means of the blower operating in the suction mode to prevent the steam from condensing in the fabric and thus avoiding moistening the material being pressed. In certain pressing operations, a very quick change-over from suction to blowing is important in order to straighten the fibres of the material being worked. In particular, however, it is important in certain pressing operations that there is no further suction after the blowing step has ended, since otherwise the already straightened fibres will collapse again.

A blower has been proposed which, after it has been switched on from an off position, makes it possible to change over from suction to blow but which, after blowing has ended, can be returned again to the off position only via the suction position. This restores the suction which adversely affects the desired pressing effect. The stream of air from the blower is regulated by means of a flap in the change-over box, and this regulation must be reset during each change-over step, based on the experience of the operator.

In another known pressing table, there is also provided a second pivotable pressing surface element which, on pivoting into its working position, automatically effects a deflection of the blower discharge air stream from the first pressing surface element to the second pressing surface element. A large pivoting angle is, however, required for a complete deflection of the stream of air from the blower, and this is regarded as time-wasting and inconvenient, for example when the pressing table is used for piecework.

It is an object of the invention to provide a blower of the type initially described, by means of which the disadvantages described above are eliminated. The aim of this is to increase the effect and the change-over speed of the blower and to ensure a correct operating sequencing.

Accordingly the present invention provides a blower for a pressing table having feed ducts between the suction side and/or the blow side of the blower and the pressing surface of the table and a change-over device which has an off position, a suction position and a blow position, wherein the change-over device is constructed to operate in such a way that, after it has assumed the said blow position, it cannot be changed over to the said suction position before being changed over to the said off position.

Further features and advantages of the invention can be seen from the description of an illustrative embodiment by reference to the Figures in which.

Figure 1:
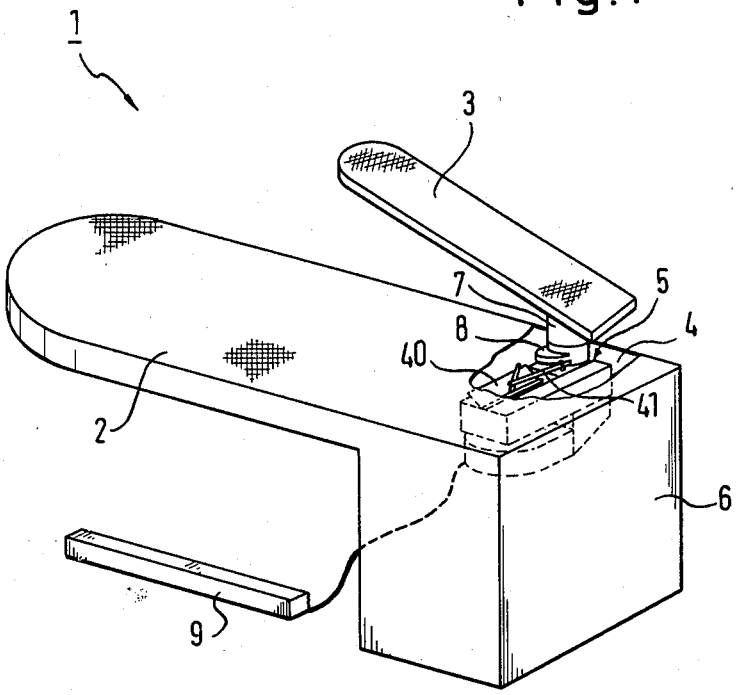
FIG. 1 is a part-sectional view showing a pressing table with the blower and an additional pressing surface element.

FIG. 1 shows a pressing table 1 with a main or first horizontal pressing surface element 2 and an additional or second horizontal pressing surface element 3 which is movable vertically, and also pivotable about a vertical axis, relative to the main one. The assembly 5 consisting of the blower fan inlet and discharge ducts is fixed to the underside 4 in the region of the base 6.

The additional pressing surface element 3 can be connected via a telescopic swivel connector in a duct to the blower assembly 5. The outer tubular part 7 of the swivel connector has on its external periphery a cam formation 8 which is in engagement with a device which will be described in detail later. The duct 7 is mounted on the blower assembly 5 and serves to deflect the stream of air from the blower onto the additional pressing surface element 3. Securing of the blower assembly 5 is effected by inserting it into an opening provided on the underside of the main table surface element 2 and screwing it thereto. The "height" adjustment of the pressing table 1 is effected by means of adjusting elements, not shown, in the base 6 of the table. An electric foot switch 9 makes it possible to change over between suction and blow, as well as to switch the blower on and off.

Figure 2:
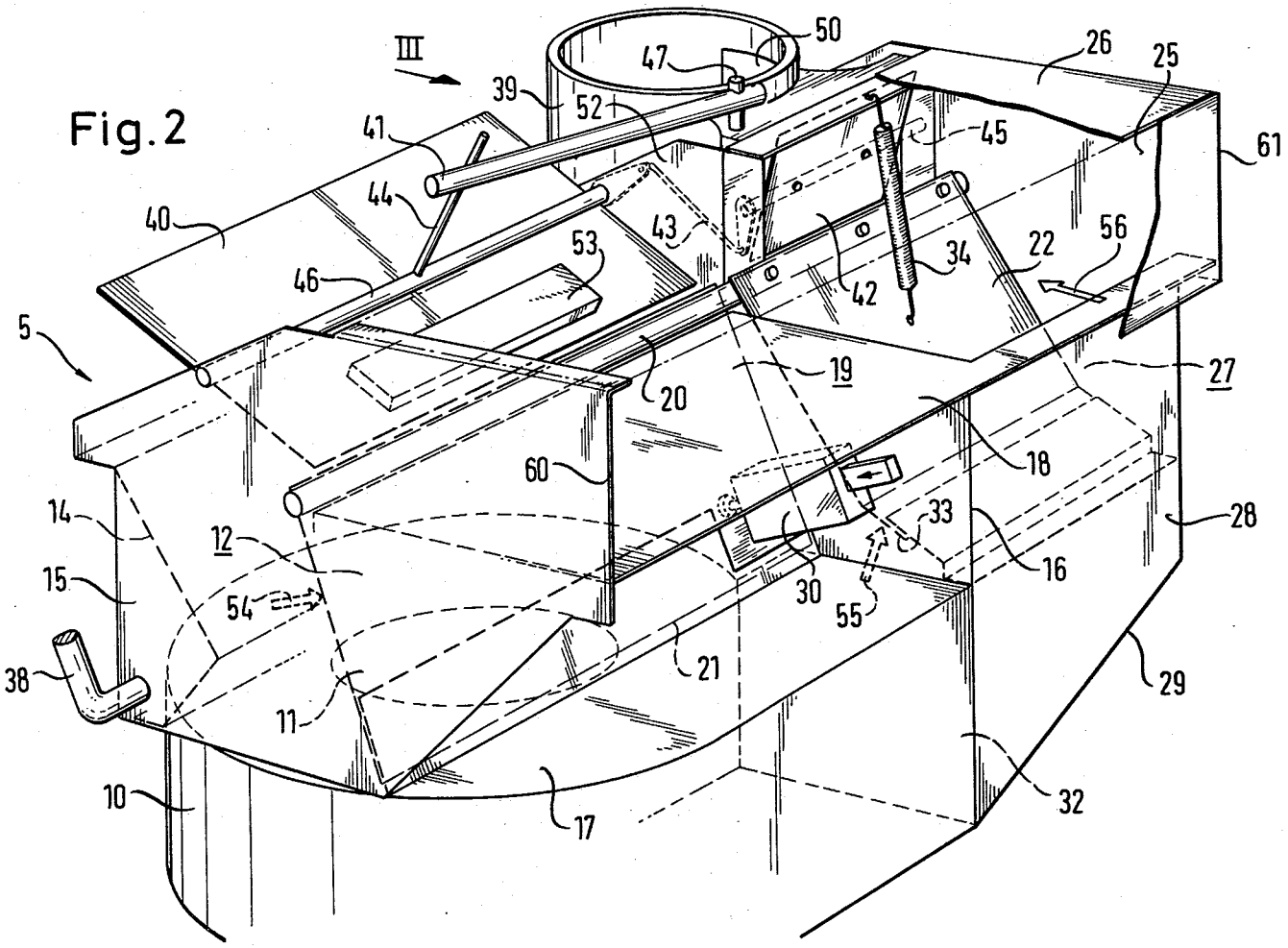
FIG. 2 is a perspective front view of the blower in part-sectional form.
Figure 3:
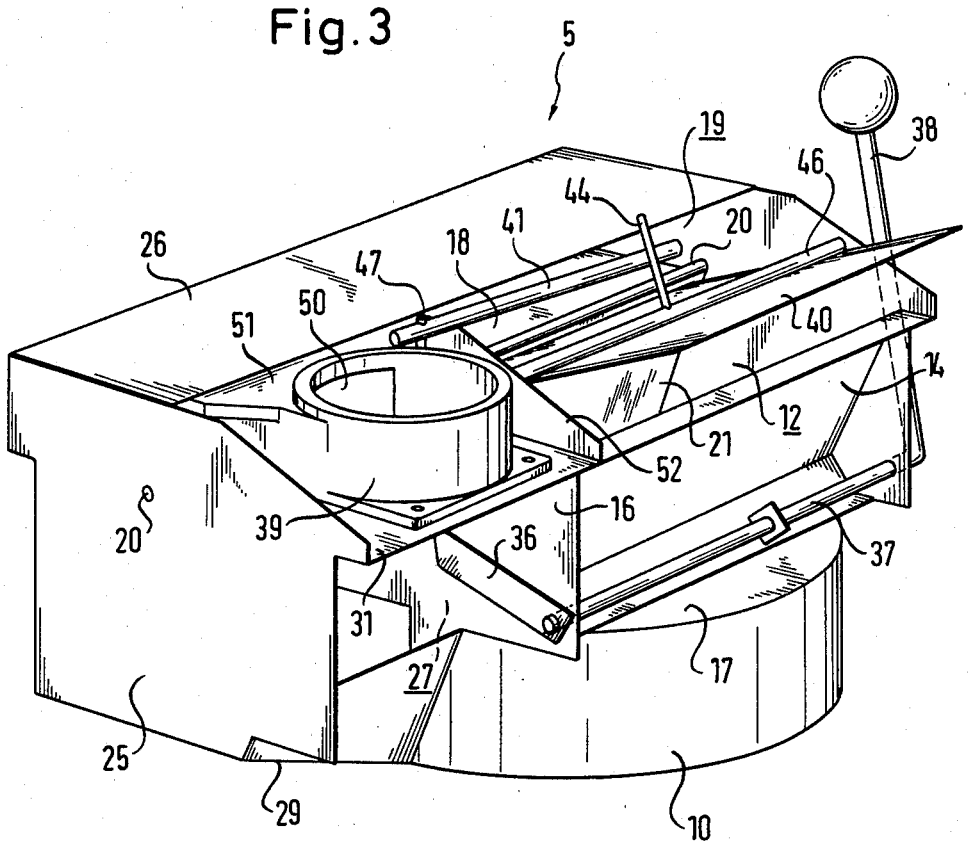
FIG. 3 is a perspective view of the blower, as seen along the direction of the arrow III in FIG. 2.

FIGS. 2 and 3 show the construction of the blower assembly 5.

The blower assembly 5 includes a fan 10 which is arranged in the lower part thereof. The suction side of the fan is connected via the suction opening 11 to a suction duct 12. The suction duct 12 is bounded by a rear wall 14, a side wall 15, a partition wall 16, the top 17 of the fan casing and a horizontal separating wall 18 of the casing. This separating wall 18 of the casing lies in the same plane as the lower boundary face of the main pressing surface element 2 and thus forms a duct which is sealed from the surroundings for the air supply to, and air removal from, the pressing surface of the first pressing surface element 2. On its side located on the top 17 of the blower, the suction duct 12 is open to atmosphere. On its side remote from the suction opening 11, the duct 12 leads into a further duct 19.

This further duct 19 is bounded by the horizontal separating wall 18 of the casing, the side wall 15 and a further side wall 25, and a top cover 26 as well as a cover side wall between edges 60, 61, and leads to the underside of the main pressing surface element 2 for guiding suction air or blowing air. On its side facing away from the fan, the duct 19 opens through a cut-out in the horizontal separating wall 18 of the casing into a duct 27.

The duct 27 is bounded by the partition wall 16, a front wall 28, the side wall 25, a bottom 29 which extends obliquely upwards from the fan discharge opening 32 towards the side wall 25, and a separating wall 31 and a wall **29*a* (both shown in FIG. 3). On the rear of the blower assembly, it is open to atmosphere. In the lower part of the partition wall 16, the duct 27 is connected to the discharge opening 32 of the fan 10**.

A shaft 20 on the separating wall 18 extends along that edge which delimits the opening of the duct 19 into the duct 12, up to and including the opening of the duct 19 into the duct 27. This shaft 20 is rotatably mounted in bearings (not shown) in the side walls 15, 25 and in the separating wall 16. A sheet metal vane 21 is secured to the shaft 20 by screwing or welding and is of such a size that, in the manner shown in FIG. 2, it can sub-divide the duct 12 into two parts and can completely close off the opening where the duct 12 communicates to atmosphere. Laterally offset relative to the sheet metal vane 21, and offset in its angular position relative thereto in a manner which can be seen from FIG. 2, a second sheet metal vane 22 is fixed to the shaft 20. The surface area of this second sheet metal vane is selected so that the latter can completely seal both the opening which communicates the duct 27 to atmosphere, and the connecting opening between the duct 27 and the duct 19. In the region 33 of vane 22, on its edge remote from the shaft 20, the sheet metal vane has a tab bent at a shallow angle towards the front wall 28 relative to the remainder of the vane 22. One end of a helical tension spring 34 is fixed approximately in the middle of the sheet metal vane 22 and the other end is fixed to the vane 26 in the vertical plane which passes through the shaft 20.

The spring rate of the spring 34 and the mutual angular offset of the sheet metal vanes 21, 22 on the shaft 20 are selected in such a way that, before the fan 10 is switched on, the vane 22 closes the opening between the duct 19 and the duct 27, while the vane 21 closes the opening of the duct 12 to atmosphere. At the same time, this makes the connection between the discharge opening 32 of the fan casing and atmosphere, via the duct 27, and also the connecting between the fan suction opening 11 and the duct 19, via the duct 12.

A solenoid 30 is fixed to the partition wall 16 and acts on the vane 21 in such a way that brief excitation of the solenoid effects movement of its armature in the direction shown by an arrow to abut the armature against the vane 21 to trigger pivoting of the vane 21 and its shaft 20.

The pivoting freedom of the sheet metal vane 22 is adjustable by means of a stop 36 (FIG. 3) which is fixed to the partition wall 16 on that side of the duct 27 which is open to atmosphere. The adjustment of the stop 36 is effected by pivoting its mounting shaft 37 by means of a lever 38. The flow rate of the suction stream or blowing stream fed to the pressing surfaces 2 and 3 can be adjusted in this way and will be subsequently retained even when a fresh working cycle is initiated, unless the lever 38 is moved.

To connect the pivotable additional pressing surface element 3 to the duct 7 an annular connector sleeve 39, preferably made of cast aluminium, is provided on the separating wall 31. In the region of the partition wall 51, (FIG. 3), this connector sleeve has a side opening 50 for connection to the duct 19. A vane 42 in the perforated partition wall 51 is symmetrically arranged on a pivot shaft 45 which is rotatably mounted in bearings (not shown) in the side wall 25 and in the partition wall 52. Moreover, a further shaft 46 leading to the side wall 15 is rotatably mounted in the partition wall 52. From the cover 26, the side wall 15 and the partition wall 52 have an oblique downward slope towards the rear of the blower assembly and, together with the upper edge of the rear wall 14 and the rear edge of the cover 26, form the opening of the duct 19 towards the main pressing surface element 2.

A vane 40 fitted symmetrically to the shaft 46 has a size such that it can completely close this opening between the duct 19 and the main pressing surface element 2, when the shaft 46 is pivoted to the appropriate position.

The shaft 46 is connected via a link 43 to the shaft 45 so that pivoting of the vane 40 necessarily effects pivoting of the vane 42. A pin 44, welded to the middle of the shaft 46 and perpendicular thereto, is in engagement with an arm 41 which is pivotable about an arbor 47. The fulcrum of the arm 41 is selected such that even a small travel of the cam formation 8, in FIG. 1, on the additional pressing surface element 3 initiates a relatively large travel of the arm 41 and thus triggers an immediate flip-over of the vane 40 to isolate the main pressing surface 2 from the blower assembly, and of the vane 42 to connect the additional pressing surface element 3 to the blower assembly. A bias weight 53 fitted on the vane 40 to one side of the shaft 46 causes the vane 40 to adopt a rest position in which the fan 10 is connected to the main pressing surface 2 via the duct 12.

The use of gearing is also conceivable for utilising the start of pivoting of the pressing surface element 3 to trigger an immediate flip-over of the vane 40.

The device described above operates in the following manner:

When the fan 10 is switched off, the sheet metal vanes 21, 22, due to their own weight and to the bias of the helical tension spring 34, adopt the suction position shown in FIG. 2, in which the opening of the suction duct 12 to atmosphere is closed by the sheet metal vane 21 and if the additional pressing surface element 3 is in its rest position, the opening between the suction duct 12 and the main pressing surface element 2 is opened by the vane 40 and also the suction duct 12 is connected to the duct 19. In this state, the sheet metal vane 22 separates the duct 27 from the duct 19. As soon as the fan 10 is switched on, a pressure force along the direction of the arrow 55 is exerted on the sheet metal vane 22 in the duct 27. As a result the "suction" position, in which suction is applied to the appropriate pressing surface element via the suction duct 12 and the extracted air is discharged to the surroundings via the fan discharge opening 32 and the duct 27, will always be reached reliably when the fan 10 is switched on.

If it is now intended to change over, from suction to blowing, the solenoid 30 in FIG. 2 is either actuated briefly or held on. As a result, the sheet metal vane 21 and hence the sheet metal vane 22 are deflected, with rotation of the shaft 20, into the air stream in such a way that the air blowing through the discharge opening 32 acts on the sheet metal vane 22 along the direction of the arrow 56 and changes over the entire change-over device, consisting of the shaft 20 and the sheet metal vanes 21 and 22, into the "blow" position. Even a brief deflection of the sheet metal vane 21 suffices here to trigger change over, since the effect of the impinging discharge air stream is greatly intensified by the angled tab 33 of the sheet metal vane 22. In the "blow" position now reached, the sheet metal vane 22 closes the opening between the duct 27 and atmosphere whilst it makes the connection between the duct 27 and the duct 19 and hence the main pressing surface element 2 into which the discharged air from the fan 10 is introduced. In the "blow" position, the sheet metal vane 21 partially or completely opens the opening between the duct 12 and atmosphere for drawing air in from the surroundings. The degree of opening of the duct 12 to atmosphere and hence the flow rate of the discharge air stream, is adjustable via the above mentioned stop 36 which limits the travel of the flap element 22.

Once the "blow" position has been reached, the "suction" position can be reached only by switching off the fan 10. The air stream from the fan through the discharge opening 32 forces the sheet metal vane 22 frictionally against the stop 36 and firmly holds it in this position. As long as the fan motor is running, a force component in the direction of the arrow 56, maintaining the "blow" position, will always be present. The sheet metal vanes 21, 22 return to their starting position or rest position, assisted by the biasing force of the tension spring 34, only after the fan motor has come to a stop. The time taken by the motor for coming to a stop can be further shortened by incorporating an electromagnetic brake on the motor, in order more rapidly to return to readiness for suction, if this is desired.

This biasing towards the "blow" position whenever the fan 10 is in operation has the advantage that it is not possible inadvertently to change back to the "suction" position and thus to vitiate the desired pressing effect. After the off-position has been reached, the fan 10 can then be restarted, whereupon suction can immediately be re-established, or, by simultaneous actuation of the fan and the solenoid 30, blowing can immediately restart without any brief preliminary suction.

In another embodiment, not shown, an immediate change-over from "blow" position to renewed "suction" position without reaching the off position can be obtained by means of a second solenoid, which may be fitted on the side wall 15, and may be actuated to effect a brief deflection of the sheet metal vane 21 in the direction of the arrow 54 and hence a change-over to the "suction" position.

The frictional resistance of the air stream is minimised by the large cross-section of the air passages formed by the ducts 12, 19, 27. The change-over from suction to blowing takes place exceedingly fast since it is servo-assisted by the air stream itself. Moreover, the device has the advantage that, when the fan 10 is switched on, the normally used suction position is always immediately established automatically.

Using the embodiment shown in FIGS. 1 to 3, it is also possible to connect the additional pressing surface element 3 to the blower.

In the position shown in FIG. 2, the vane 40 is in the starting position which is set by the bias weight 53 and in which the opening between the suction duct 12 and the main pressing surface element 2 is open and the vane 42, in the connection between the duct 19 and the inner tubular connector sleeve 39 of the swivel connector, is closed.

When the additional pressing surface element 3 is now pivoted into its working position, the arm 41 is immediately actuated via the cam formation 8 when the pivoting starts. This arm 41 pivots about the arbor 47 and acts on the pin 44 so that the vane 40 pivots about the shaft 46, closing the opening between the suction duct 12 and the main pressing surface element 2 and making the connection between the suction duct 12 and the duct 19. At the same time, the vane 42 is pivoted by the link 43 rotating the shaft 45 and frees the connection between the inner connector sleeve 39 and the duct 19. In this position, the main pressing surface element 2 is thus isolated and the additional pressing surface element 3 is connected to the suction opening 11 of the fan via the outer tubular part 7 of the swivel connector, the duct 19 and the suction duct 12.

The degree of pivoting of the vane 42 is about 60° so that the cross-section of the connecting passage between the duct 19 and the connector sleeve 39 is substantially freed. The change-over from "suction" position to "blow" position takes place in the same way as described above, in that the vane 22 closes that opening of the duct 27 which leads to atmosphere so that the air stream from the fan blows directly through the duct 27 and the open vane 42 into the additional pressing surface element 3.

When the additional pressing surface element 3 is pivoted back into its rest position, the arm 41 is freed to be pivoted back by the pin 44 so the gravity biased vane 40 pivots back into its starting position and simultaneously pivots the vane 42 to close the connection between the duct 19 and the inner connector sleeve 39 of the swivel coupling. As a result, the additional pressing surface element 3 is isolated from the fan 10, and the main pressing surface element 2 will be re-connected to the fan.

Upon shut-down, the discharge air stream from the fan 10 holds the change-over device in the "blow" position until the output of the fan has fallen to about 5% of normal. As indicated above, if more rapid switching-off is desired the fan motor can be braked by an additional device such as an electromagnetic brake.

I claim:

1. A blower for a pressing table, said blower including fan means, a suction side of said fan means and a blowing side of said fan means, passage means for connecting said suction side and said blowing side to a said pressing table in which the blower is incorporated, and alternately operable deflector means having a suction position in which said suction side of said fan means is communicated to said passage means and having a blowing position in which said blowing side of said fan means is communicated with said passage means, said deflector means being operable to switch from said suction position to said blowing position but not from said blowing position to said suction postion until said fan means has been deactivated.

2. A blower according to claim 1, wherein said air deflector means includes an air deflector member having a closed position and an open position, means biasing said air deflector member to its closed position, trigger means initiating movement of said air deflector member from said closed position towards said open position, and means directing the air passing through said fan means onto said air deflector member for aerodynamically biasing said air deflector member for continued movement towards said closed position after operation of said trigger means.

3. A blower according to claim 2, and including adjustable stop means for limiting the travel of said deflector member from said closed position towards said open position, said adjustable stop means being effective to allow the intensity of the air stream passing through said fan means to be pre-selected before operation of said trigger means.

4. A blower according to claim 3, wherein said adjustable stop is frictionally constrained to hold a given position during several successive operations of said trigger means and aerodynamic biasing.

5. A blower according to any one of claims 1 to 4, wherein said passage means comprise a common duct arranged to be communicated by said alternately operable deflector means with one of said suction side and said blowing side of the fan means, and first and second delivery passages, and including means selectively communicating one of said first and second passages with said common duct.

6. A pressing table including main pressing table surface means, additional pressing table surface means, means pivotably mounting said additional pressing table surface means with respect to said main pressing table surface means between a rest position and an operative position, a blower according to claim 5 having said first passage connected to said main pressing table surface means and said second passage connected to said additional pressing table surface means, and means operatively connecting said pivotal mounting means for said additional pressing table surface means with said means for selectively communicating said first and second passages with said common duct, said last means being effective to disconnect said first passage from said common duct and to connect said second passage to said common duct in response to pivoting movement of said additional pressing table surface means from said rest position towards said operative position.

* * * * *